US012799839B2

(12) United States Patent
Wallace et al.

(10) Patent No.: US 12,799,839 B2
(45) Date of Patent: Nov. 17, 2026

(54) RCD HOUSING AND COUPLING METHOD

(71) Applicant: Hydril USA Distribution LLC, Houston, TX (US)

(72) Inventors: David Wallace, Houston, TX (US); Hunter Haeberle, Houston, TX (US); Kevin Sweeney, Houston, TX (US); Rick Stringfellow, Houston, TX (US); Katie Kotarek, Houston, TX (US)

(73) Assignee: Hydril USA Distribution LLC, Houston, TX (US)

( * ) Notice: Subject to any disclaimer, the term of this patent is extended or adjusted under 35 U.S.C. 154(b) by 0 days.

(21) Appl. No.: 18/919,024

(22) Filed: Oct. 17, 2024

(65) Prior Publication Data

US 2025/0129685 A1 Apr. 24, 2025

Related U.S. Application Data

(60) Provisional application No. 63/591,207, filed on Oct. 18, 2023.

(51) Int. Cl.

| | |
|---|---|
| ***E21B 33/08*** | (2006.01) |
| ***E21B 17/042*** | (2006.01) |
| ***E21B 23/06*** | (2006.01) |

(52) U.S. Cl.
CPC ..... *E21B 33/085* (2013.01); *E21B 17/042* (2013.01); *E21B 23/06* (2013.01)

(58) Field of Classification Search
CPC ..... E21B 33/03; E21B 33/085; E21B 17/042; E21B 17/02
See application file for complete search history.

(56) References Cited

U.S. PATENT DOCUMENTS 2,534,528 A * 12/1950 Page ..... E21B 33/1265 166/131
2015/0048611 A1* 2/2015 Shanks, II ..... E21B 17/02 285/18

* cited by examiner

*Primary Examiner* — Kristyn A Hall
(74) *Attorney, Agent, or Firm* — Osha Bergman Watanabe & Burton LLP

(57) ABSTRACT

An other end connection including an inner housing assembly, including an upper housing and a coupling assembly. The coupling assembly includes a threaded sleeve positioned around the upper housing. The threaded sleeve includes a first set of threads on a first axial end and a second set of threads on a second axial end. The coupling assembly also includes a threaded ring threaded to the threaded sleeve and positioned radially between the threaded sleeve and the upper housing.

6 Claims, 10 Drawing Sheets

RCD HOUSING AND COUPLING METHOD

BACKGROUND

An "other end connection" (OEC) is a term commonly used in the oil and gas industry to refer to connections (e.g., connection make-ups, sizes, etc.) that are not specified in the API (American Petroleum Institute) or ISO (International Standards Organization) standards. OECs are often used to join pressure-containing or pressure-controlling equipment, such as wellhead inner housing assemblies. A rotating control device (RCD) is an example of a frequently used application of an OEC.

RCDs are used to contain and redirect annular flow of fluids through a well. An RCD is typically positioned at the top of a blowout preventer (BOP). When installed, the RCD seals around a rotating drill pipe. One or more controlled flowlines may be provided below the seal, through which fluids from the well may be diverted.

FIG. 1 shows an example of a generic RCD 100 mounted at the top side of a BOP 110, for use in one or more operations of a well 101. The RCD 100 includes an outer housing 102 that may be bolted to the BOP 110 or other connecting component. The RCD further includes an inner rotating housing 104 rotatably mounted within in the outer housing 102 using one or more bearing assemblies. One or more sealing elements 106 (e.g., strippers) are connected to the inner rotating housing 104. The sealing elements 106 contact and seal against drill pipe 120 as the drill pipe 120 is extended into and rotated within the well 101. The RCD 100 may be driven by a Kelly or other assembly to rotate the inner rotating housing 104 with the drill pipe 120.

Due to the stresses and/or harsh environments RCD sealing elements are exposed to, the sealing elements may be replaced from time to time. Additionally, other operational considerations may necessitate removal and/or disassembly of an RCD. However, due to the functional requirements of an RCD (e.g., being fixedly mounted to other well equipment and maintaining a seal with drill pipe as it is lowered into and rotated in a well), disassembly of the RCD is typically complex and burdensome.

SUMMARY OF THE DISCLOSURE

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to other end connections that include an inner housing assembly. The inner housing assembly includes an upper housing and a coupling assembly. The coupling assembly includes a threaded sleeve positioned around the upper housing, the threaded sleeve having a first set of threads on a first axial end and a second set of threads on a second axial end. The coupling assembly also includes a threaded ring threaded to the threaded sleeve and positioned radially between the threaded sleeve and the upper housing.

In another aspect, embodiments disclosed herein methods for joining housing components that includes assembling an other end connection between the housing components. The other end connection may be assembled by assembling an upper housing axially adjacent to a lower housing to form an inner housing assembly, threading a first axial end of a threaded sleeve around an upper axial end of the lower housing, and threadedly connecting a threaded ring radially between a second axial end of the threaded sleeve and the upper housing. As the threaded ring is moved to thread ably connect the threaded ring radially between the threaded sleeve and the upper housing, the threaded ring is contacted against a protruding feature along a lower axial end of the upper housing. A backout prevention screw may be inserted through the threaded ring to contact the upper housing.

In yet another aspect, embodiments disclosed herein relate to methods of joining housing components that include assembling an other end connection, installing a packer assembly within the other end connection, and placing the other end connection comprising the packer assembly inside an outer housing. The other end connection may include an inner housing assembly of an upper housing and a lower housing and a coupling assembly including a threaded sleeve and a threaded split ring.

Other aspects and advantages will be apparent from the following description and the appended claims.

BRIEF DESCRIPTION OF DRAWINGS

Wherever possible, like or identical reference numerals are used in the figures to identify common or the same elements. The figures are not necessarily to scale, and certain features and certain views of the figures may be shown exaggerated in scale for purposes of clarification.

DETAILED DESCRIPTION

Embodiments disclosed herein relate generally to other end connections (OEC) and methods of their assembly and disassembly.

Examples of an OEC according to embodiments of the present disclosure are described with reference to their use in RCDs. However, OECs according to embodiments of the present disclosure may be used for other housing connections and applications.

Traditional standardized flanges and/or clamps (e.g., designed according to API or ISO standards) are commonly used with OECs (such as in RCDs) due to their reliability and standardization. However, these connection systems may be slow and/or cumbersome to makeup, may use high torques, and may be difficult to handle. By using OECs according to embodiments of the present disclosure, a housing connection may be quickly assembled and disassembled (e.g., for repair) without sacrificing pressure control.

Figure 1:
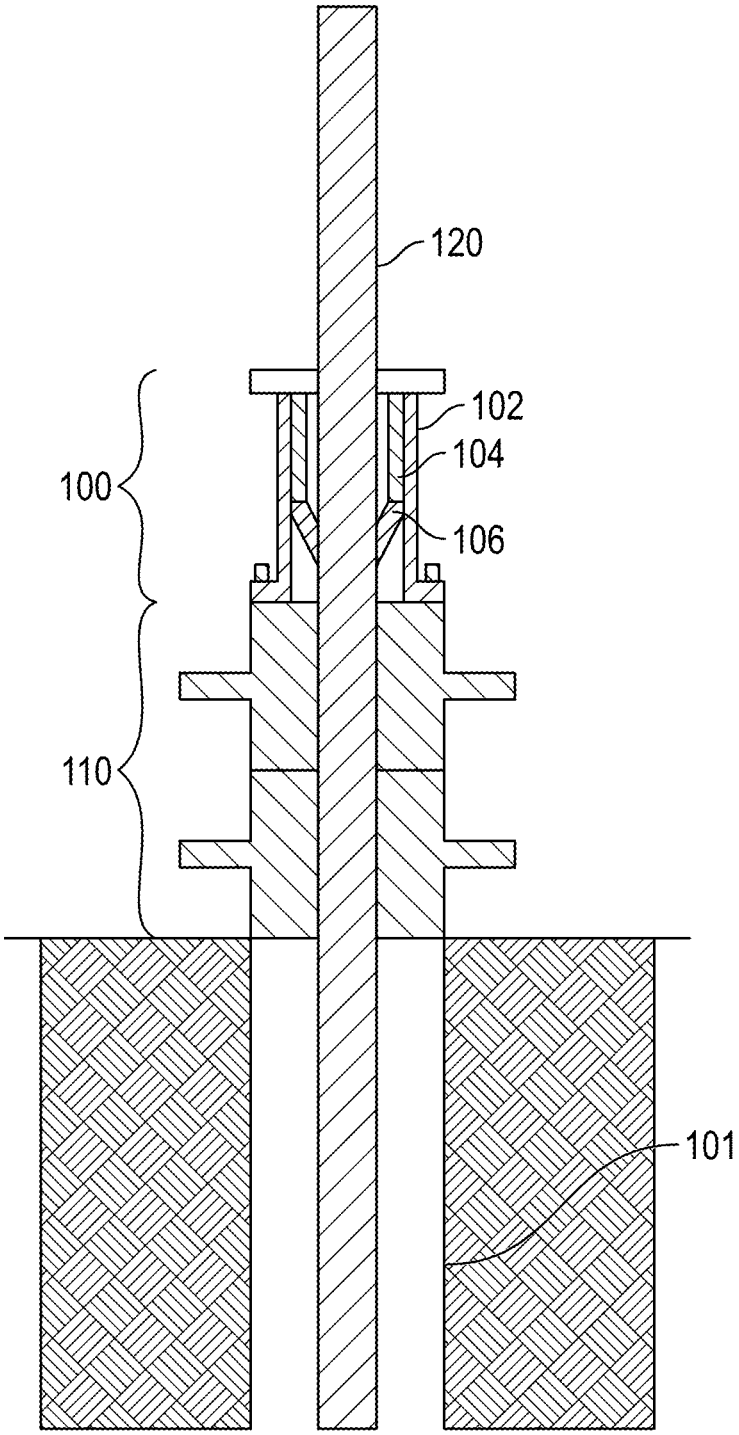
FIG. 1 (Prior Art)
FIG. 1 shows a conventional RCD assembled in a well system.
Figure 2A:
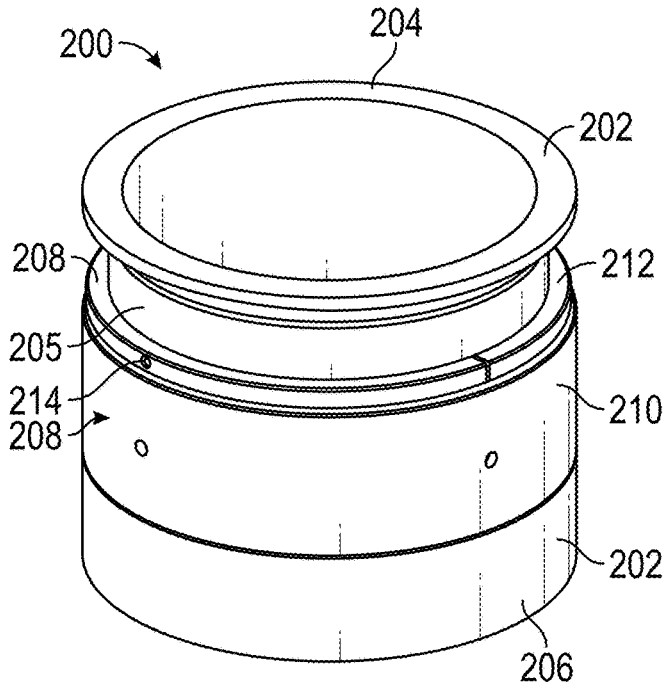
FIG. 2A shows an OEC in accordance with one or more embodiments.
Figure 2B:
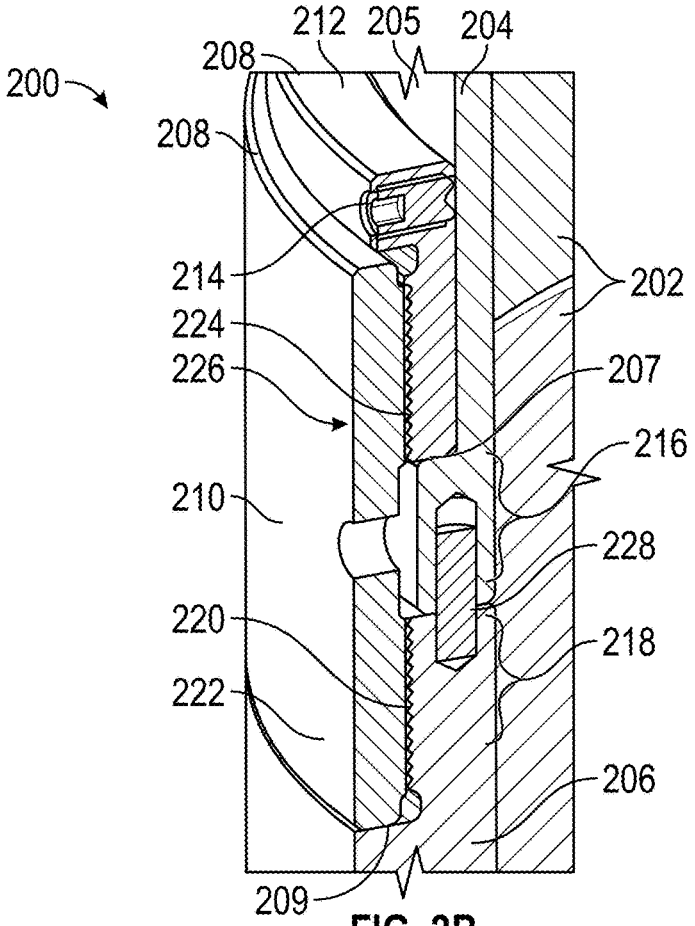
FIG. 2B shows a cross section of the OEC in FIG. 2A, in accordance with one or more embodiments.

FIGS. 2A-B show an example of an OEC of one or more embodiments. FIG. 2A shows a perspective view of the OEC 200, and FIG. 2B shows a partial cross-sectional view of a connection portion of the OEC 200. The OEC 200 includes an inner housing assembly 202, where the inner housing assembly 202 includes an upper housing 204 and a lower housing 206. The upper housing 204 and lower housing 206 each have a generally tubular shape and may be sized and shaped such that when the upper housing 204 and lower housing 206 are assembled together, the inner housing assembly 202 also has a generally tubular shape.

The inner housing assembly may be any inner housing assembly on any tubular body requiring a coupling connection. For example, the inner housing assembly may be piping, tubing, casing, flexible tubing, coiled tubing, and the like. In one or more embodiments, the opposite axial ends of the inner housing assembly 202 may be mounted to other components, integrally formed with equipment, mounted inside equipment, or otherwise integrated with different equipment, depending on the application in which the OEC 200 is being used.

The OEC 200 also includes a coupling assembly 208 which includes a threaded sleeve 210 and a threaded ring. The threaded ring may be a threaded split ring 212 split in two segments (having two split joints when assembled together) or may be split in more than two segments. When the threaded split ring 212 segments are assembled together, the threaded split ring 212 has a generally tubular shape. Further, when the threaded split ring 212 segments are assembled together, the threaded split ring 212 may have an inner diameter that corresponds with an outer diameter of the inner housing assembly 202, such that the threaded split ring 212 fits around an outer surface of the inner housing assembly 202. For example, as best seen in FIG. 2B, the threaded split ring 212 may be assembled around a first outer surface 205 of the upper housing 204, where the first outer surface 205 defines a first outer diameter of the upper housing 204. When the segments of the threaded split ring 212 are assembled together around the upper housing 204, the threaded split ring 212 has an inner surface that interfaces with the first outer surface 205 of the upper housing 204. As discussed in more detail below, threads may be provided around an outer surface of the threaded split ring 212, which may be threaded to an inner surface of the threaded sleeve 210.

In one or more embodiments, the upper housing 204 may further include a stepped outer profile, where a step or other protruding feature may define an increased outer diameter of the upper housing 204. For example, as shown in FIG. 2B, the upper housing 204 includes a step 207 formed by rise and run surfaces at a lower axial end 216 of the upper housing, where the rise surface of the step 207 defines a second outer diameter greater than the first outer diameter defined by the first outer surface 205. The step 207 may act as a stopper to support the threaded split ring 212 in an axial position along the upper housing 204, where a lower surface of the threaded split ring 212 may interface with a run surface of the step 207.

The threaded split ring 212 may be threaded concentrically within the threaded sleeve 210, such that the threaded split ring 212 partially axially overlaps with the threaded sleeve 210. For example, as shown in the embodiment in FIGS. 2A-B, the threaded sleeve 210 has an annular body, where threads are formed on the inner surface of the annular body to threadedly connect with both the threaded split ring 212 and the lower housing 206. Particularly, the threaded sleeve 210 includes a first set of threads 220 formed on the inner surface along a first axial end 222 of the threaded sleeve 210 and a second set of threads 224 on the inner surface along a second axial end 226 of the threaded sleeve 210. As best shown in FIG. 2B, the first set of threads 220 of the threaded sleeve 210 are threaded to threads formed around an outer surface of an upper axial end 218 of the lower housing 206. The second set of threads 224 of the threaded sleeve 210 are threaded to the threads formed around the outer surface of the threaded split ring 212.

The OEC 200 may be assembled by threading the threaded sleeve to the lower housing 206 and axially stacking the upper housing 204 and lower housing 206, such that the lower axial end 216 of the upper housing 204 is axially adjacent the upper axial end 218 of the lower housing 206. Depending on the shape and size of the upper housing 204, the threaded sleeve 210 may be threaded to the lower housing 206 prior to axially stacking the upper and lower housings 204, 206, or the threaded sleeve 210 may be slid around the upper housing 204 and threaded to the lower housing 206 after axially stacking. For example, an upper housing 204 may have an upper axial end (e.g., which may be a second connection end or other component element, depending on the end use of the OEC 200) with an outer diameter greater than the inner diameter of the threaded sleeve 210. In such embodiments, where the threaded sleeve 210 would not fit around the upper axial end of the upper housing 204, the threaded sleeve 210 may be threaded to the lower housing 206, and then the upper housing 204 may be inserted through the threaded sleeve 210 to be positioned axially adjacent the lower housing 206.

In the embodiment shown, the lower housing 206 includes a protrusion 209, having an outer diameter greater than the upper axial end 218 of the lower housing 206, which may act as an axial stopper preventing the threaded sleeve 210 from being threaded past an axial position along the lower housing 206. The threaded sleeve 210 may be threaded to the upper axial end 218 of the lower housing 206 until a lower surface of the threaded sleeve 210 abuts the protrusion 209.

Keeping with FIG. 2B, one or more housing anti-rotation keys 228 may be disposed between the lower axial end 216 of the upper housing 204 and the upper axial end 218 of the lower housing 206 to prevent relative rotation between the upper housing 204 and the lower housing 206. A housing anti-rotation key 228 may be inserted at one end in a cavity formed in the lower axial end 216 of the upper housing 204 and at an opposite end in a cavity formed in the upper axial end 218 of the lower housing 206, such that the housing anti-rotation key 228 extends partially into both the upper and lower housings 204, 206. By extending into angularly aligned cavities formed in the upper and lower housings 204, 206, the housing anti-rotation key 228 may prevent the upper and lower housings 204, 206 from rotating relative to each other as components of the OEC are threaded together.

Keeping with FIG. 2B, the threaded sleeve 210 includes a second set of threads 224 on a second axial end 226. The threaded split ring 212 may be stacked on the lower axial end 216 of the upper housing 204 and may be threaded to the second set of threads 224 on the second axial end 226 of the threaded sleeve 210. For example, in one or more embodiments, after the threaded sleeve 210 is threaded to the lower housing 206 and the inner housing assembly 202 is assembled, segments of the threaded split ring 212 may be positioned around the upper housing 204 and rotated as it is moved axially toward the lower housing 206 to thread the threaded split ring 212 concentrically between the threaded sleeve 210 and the upper housing 204. The threaded split ring 212 may be threaded within the threaded sleeve 210, between the threaded sleeve 210 and upper housing 204, until the threaded split ring 212 lands on the step 207 of the upper housing 204 and axially compresses the upper housing 204 on the lower housing 206.

The threaded split ring 212 may also include one or more backout prevention screws 214 disposed in the threaded split ring 212 to prevent unintentional retraction of the OEC 200. For example, in the embodiment shown, after the threaded split ring 212 is installed between the threaded sleeve 210 and upper housing 204, a backout prevention screw 214 may be screwed into a through-hole formed through the thickness of the threaded split ring 212 until the backout prevention screw 214 contacts (and in some cases, partially indents into) the upper housing 204.

Figure 3A:
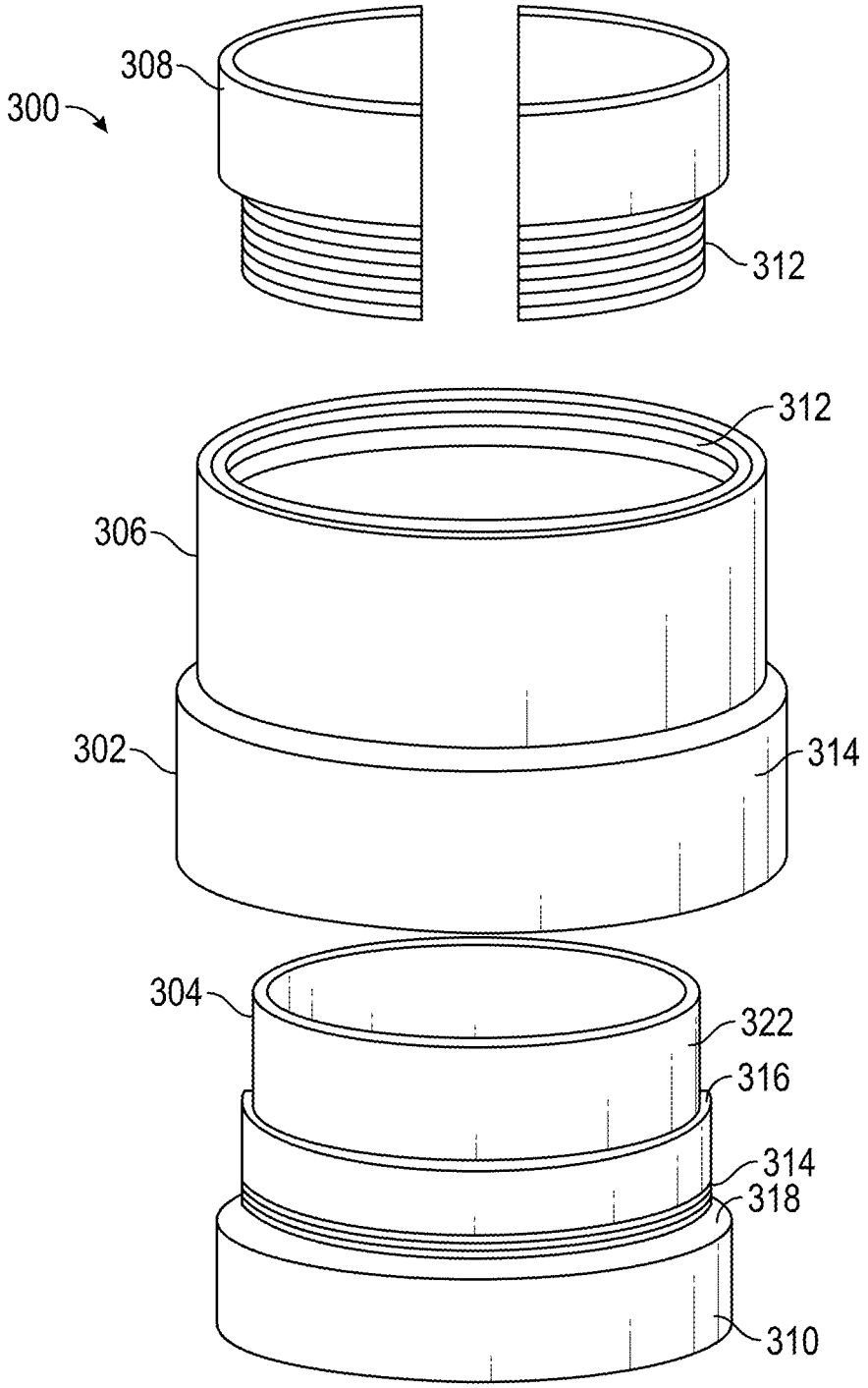
FIG. 3A shows an OEC in accordance with one or more embodiments.
Figure 3B:
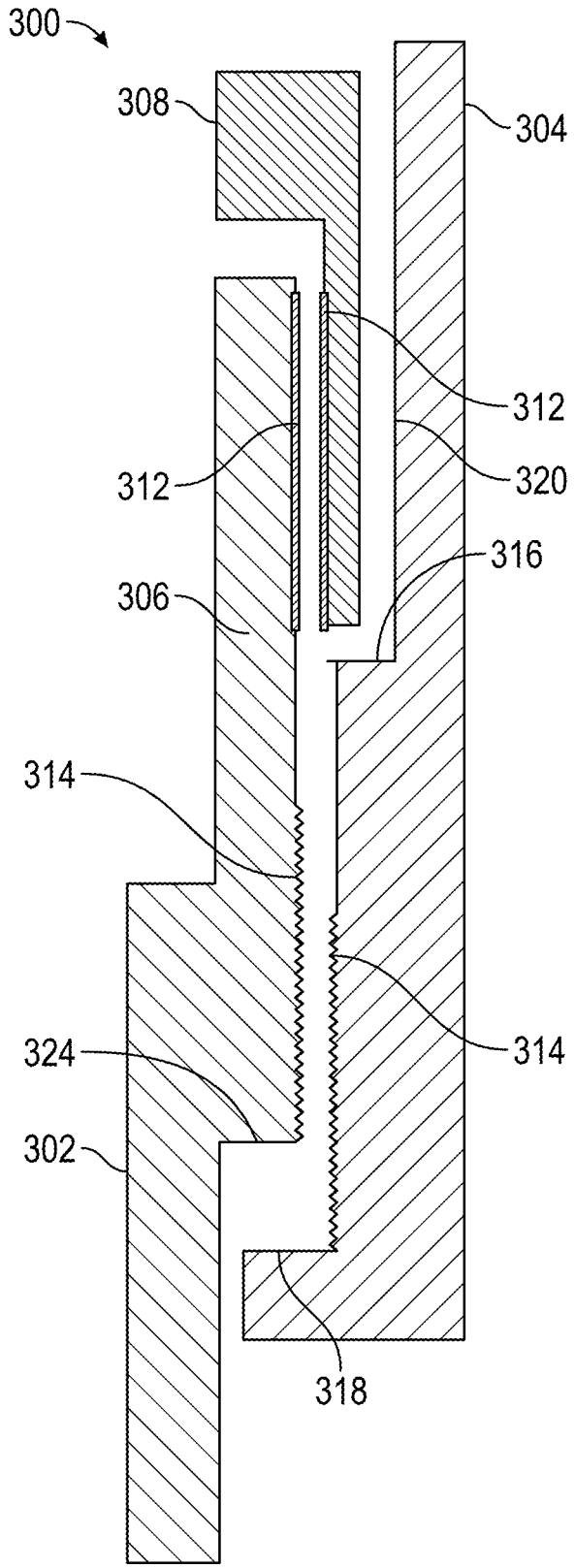
FIG. 3B shows a cross section of the OCE in FIG. 3A, according to one or more embodiments.

FIGS. 3A-B shows an alternative embodiment of an OEC according to one or more embodiments. FIG. 3A shows a perspective view of the OEC 300 components and FIG. 3B shows a partial cross-sectional view of a connection portion of the OEC 300 when the components are assembled. The OEC 300 includes an upper housing 304, a lower housing 302 which is integrally formed with a threaded sleeve section 306, and a threaded split ring 308, each of which have a generally tubular assembled shape and may be sized and shaped such that when the components are assembled together, the OEC 300 also has a generally tubular shape.

The upper and lower housings may include any body requiring a fluid coupling connection. For example, the upper and lower housings may be piping, tubing, casing, flexible tubing, coiled tubing, and the like. In one or more embodiments, the opposite axial ends of the upper housing 304 and the lower housing 302 may be mounted to other components, integrally formed with equipment, mounted inside equipment, or otherwise integrated with different equipment, depending on the application in which the OEC 300 is being used.

The OEC 300 also includes a threaded ring, which may be a threaded split ring 308 split in two segments (having two split joints around the circumference of the ring when assembled together) or may be split in more than two segments. When the threaded split ring 308 segments are assembled together, the threaded split ring 308 has a generally tubular shape. Further, when the threaded split ring 308 segments are assembled together, the threaded split ring 308 may have an inner diameter that corresponds with an outer diameter of the upper housing 304, such that the threaded split ring 308 fits around an outer surface of the upper housing 304. For example, as best seen in FIG. 3B, the threaded split ring 308 may be assembled around a first outer surface 320 of the upper housing 304, where the first outer surface 320 defines a first outer diameter of the upper housing 304. When the segments of the threaded split ring 308 are assembled together around the upper housing 304, the threaded split ring 308 has an inner surface that interfaces with the first outer surface 320 of the upper housing 304. As discussed in more detail below, threads may be provided around an outer surface of the threaded split ring 308, which may be threaded to an inner surface of the threaded sleeve section 306 of the lower housing 302.

In one or more embodiments, the upper housing 304 may further include a stepped outer profile, where one or more steps or other protruding features may define an increased outer diameter of at least one section of the upper housing 304. For example, as shown in FIG. 3A, the upper housing 304 includes an upper step 316 formed by rise and run surfaces near an upper axial end 322 of the upper housing 304, where the rise surface of the upper step 316 defines a second outer diameter greater than the first outer diameter defined by the first outer surface 320. The upper step 316 may act as a stopper to support the threaded split ring 308 in an axial position along the upper housing 304, where a lower surface of the threaded split ring 308 may interface with a run surface of the upper step 316. The upper housing 304 may also include a lower step 318 formed by rise and run surfaces near a lower axial end 310 of the upper housing 304, which is axially opposite from the upper axial end 322. The rise surface of the lower step 318 defines a third outer diameter greater than the first outer diameter defined by the first outer surface 320 and greater than the second outer surface defined by the rise surface of the upper step 316. The lower step 318 may act as a stopper to support a lower surface 324 of the lower housing 302, where the lower surface 324 may interface with a run surface of the lower step 318.

As shown in the embodiment in FIGS. 3A-B, the threaded sleeve section 306 may be integrally formed with the lower housing 302 at an upper axial end of the lower housing. The threaded sleeve section 306 may have an annular shape, where a first set of threads 314 are formed on an inner surface of the threaded sleeve section to threadedly connect to a first set of threads 314 formed on the upper housing 304. The threaded sleeve section 306 may also have a second set of threads 312 formed on an inner surface of the annular body to threadedly connect to a second set of threads 312 formed on the threaded split ring 308, such that the threaded split ring 308 may be threaded concentrically within the integrally formed threaded sleeve section 306 of the lower housing 302, and such that the threaded split ring 308 partially axially overlaps with the threaded sleeve section 306.

As best shown in FIG. 3B, the OEC 300 may be assembled by axially stacking the upper housing 304 and lower housing 302, such that a lower portion of the upper housing 304 and an upper portion of the lower housing 302 are in a shared axial position and overlap. In the embodiment shown, the lower axial end 310 of the upper housing 304 is axially adjacent the lower surface 324 of the lower housing 302, such that the lower surface 324 interfaces with the lower step 318 of the upper housing 304. The first set of threads 314 formed on the lower housing 302 may then be threaded to the first set of threads 314 formed on the upper housing 304. The threaded split ring 308 may be stacked on the upper step 316 of the upper housing 304, abutting the first outer surface 320 of the upper housing 304. The threaded split ring 308 may be threaded to the second set of threads 312 on the integrally formed threaded sleeve section 306 of the lower housing 302. For example, in one or more embodiments, segments of the threaded split ring 308 may be positioned around the upper housing 304 and rotated as it is moved axially toward the lower housing 302 to thread the threaded split ring 308 concentrically between the threaded sleeve section 306 and the upper housing 304. The threaded split ring 308 may be threaded within the threaded sleeve section 306, between the threaded sleeve section 306 and upper housing 304, until the threaded split ring 308 lands on the upper step 316 of the upper housing 304.

The embodiment shown in FIGS. 3A-B may contain other features as described in FIGS. 2A-B, such as a protrusion 209, one or more housing anti-rotation keys 228, and a backout prevention screw 214, depending on the application for which the OEC 300 is used.

Figure 6:
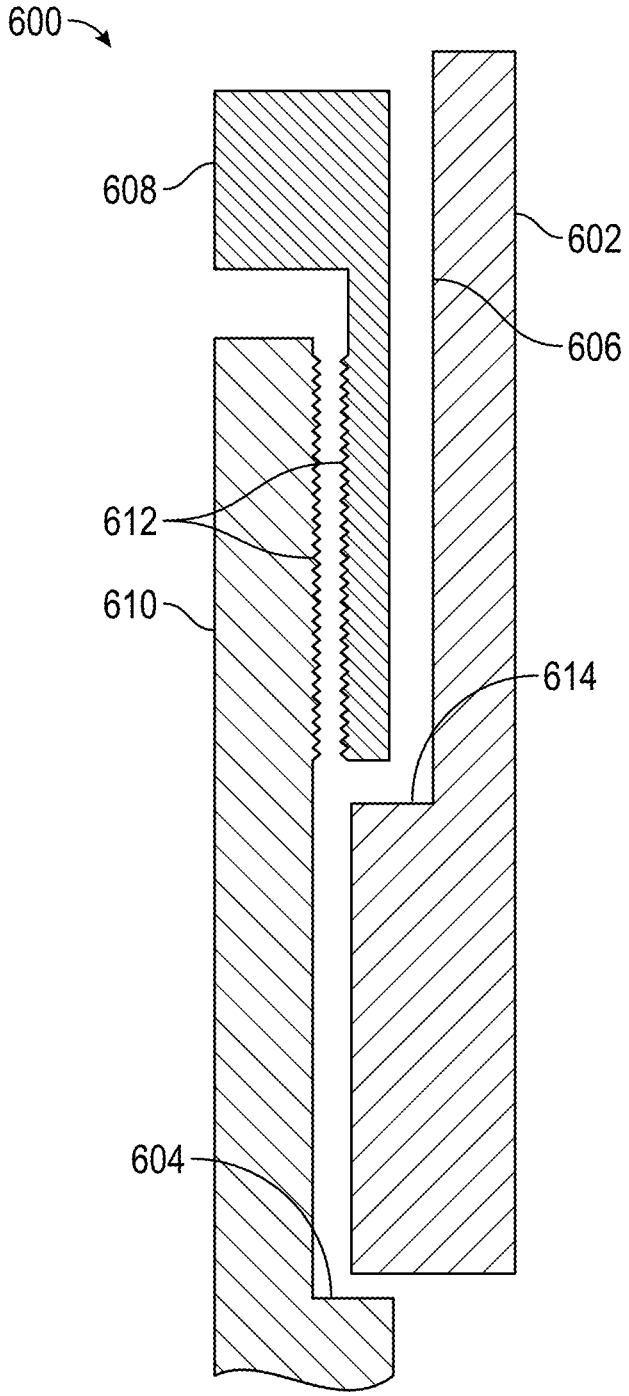
FIG. 6 shows a cross section of an alternative OCE arrangement in accordance with one or more embodiments.

FIG. 6 shows another embodiment of an OEC disclosed herein. The OEC 600 of FIG. 6 includes a housing 602, a threaded sleeve assembly 610 and a threaded ring, which may be sized and shaped such that when the housing 602, the threaded ring, and the threaded sleeve assembly 610 are assembled together, the OEC 600 also has a generally tubular shape. The housing and threaded sleeve assembly may include any tubular body requiring a coupling connection as described in the sections above.

The threaded ring may be a threaded split ring 608 split in two segments (having two split joints when assembled together) or may be split in more than two segments. When the threaded split ring 608 segments are assembled together, the threaded split ring 608 has a generally annular shape. Further, when the threaded split ring 608 segments are assembled together, the threaded split ring 608 may have an inner diameter that corresponds with an outer diameter of the housing 602, such that the threaded split ring 608 fits around a first outer surface 606 of the housing 602. When the segments of the threaded split ring 608 are assembled together around the housing 602, the threaded split ring 608 has an inner surface that interfaces with the first outer surface 606 of the housing 602.

In one or more embodiments, the housing 602 may further include a stepped outer profile, where one or more steps or other protruding features may define an increased outer diameter of at least one section of the housing 602. For example, the housing 602 of FIG. 6 includes an upper step 614 where a rise surface of the upper step 614 defines a second outer diameter greater than the first outer diameter defined by the first outer surface 606. Similarly, the threaded sleeve assembly 610 may include as stepped inner profile, where a rise surface of a lower step 604 defines a second inner diameter less than a first inner diameter of the threaded sleeve assembly 610.

The threaded sleeve assembly 610 has an annular body, where a set of threads 612 are formed on an inner surface of the annular body to threadedly connect to a set of threads 612 formed on the threaded split ring 608, such that the threaded split ring 608 may be threaded concentrically within the threaded sleeve assembly 610, and such that the threaded split ring 608 partially axially overlaps with the threaded sleeve assembly 610. The threaded sleeve assembly 610 may also optionally have a second set of threads formed on an inner surface of the annular body to threadedly connect to a second set of threads formed on a lower section of the housing 602.

The OEC 600 may be assembled by axially stacking the housing 602 and the threaded sleeve assembly 610, such that a lower axial end of the housing 602 is axially adjacent to lower section of the threaded sleeve assembly 610, and such that the lower axial end of the housing 602 interfaces with the lower step 604 of the threaded sleeve assembly. The threaded split ring 608 may be stacked on the upper step 614 of the housing 602, abutting the first outer surface 606 of the housing 602. The threaded split ring 608 may be threaded to the set of threads 612 on the threaded sleeve assembly 610, for example, by positioning segments of the threaded split ring 608 around the housing 302 and rotating the segments as the threaded split ring 608 is moved axially toward the upper step 614 to thread the threaded split ring 608 concentrically between the threaded sleeve assembly 610 and the housing 602. The threaded split ring 608 may be threaded within the threaded sleeve assembly 610, between the threaded sleeve assembly 610 and the housing 602, until the threaded split ring 608 lands on the upper step 614 of the housing 602.

The embodiment shown in FIG. 6 may contain other features as described in FIGS. 2A-B, such as a protrusion 209, one or more housing anti-rotation keys 228, and a backout prevention screw 214, depending on the application for which the OEC 600 is used.

Figure 4:
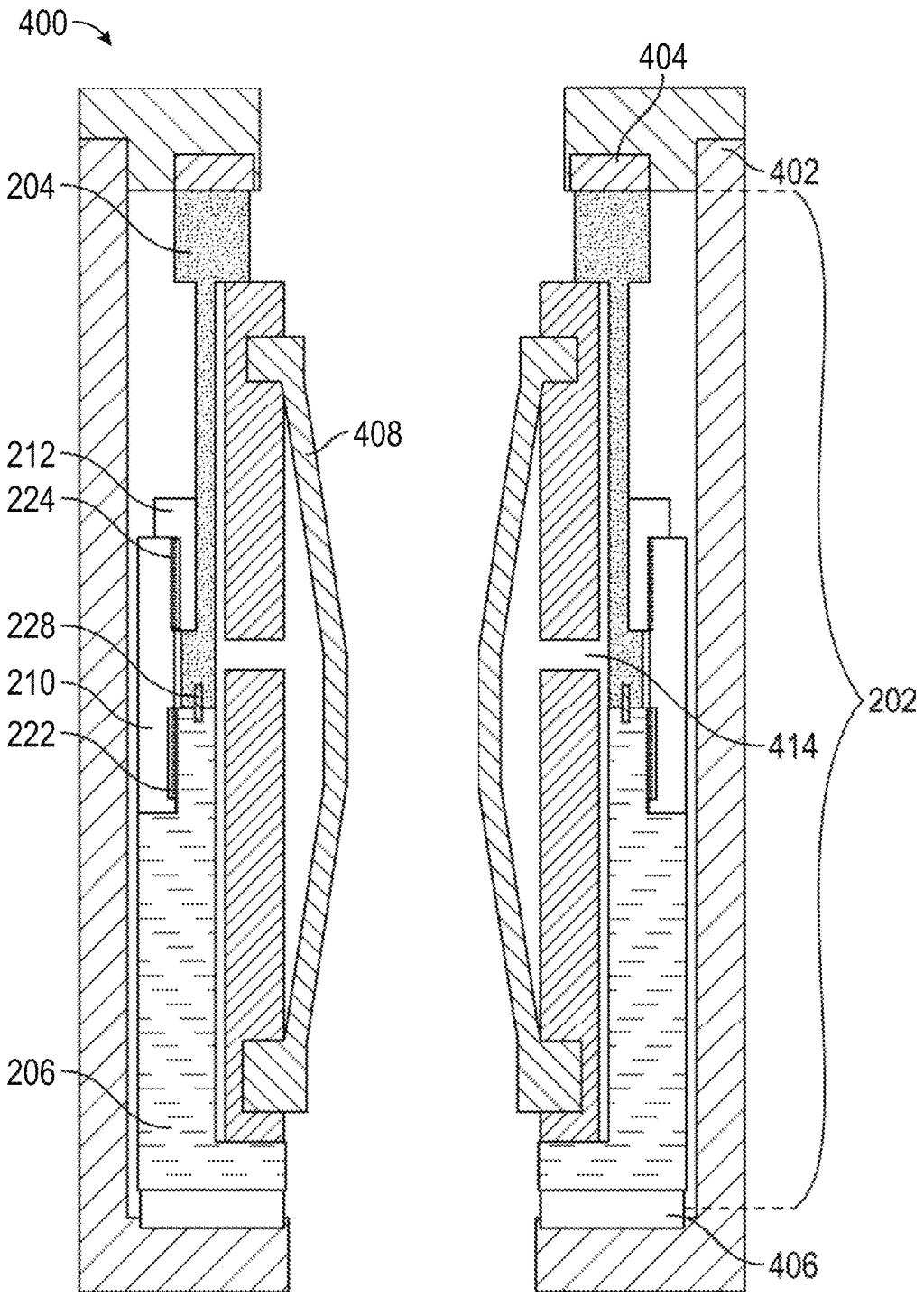
FIG. 4 shows a cross-sectional view of an RCD with an OEC according to embodiments of the present disclosure.

FIG. 4 shows a cross-sectional view of an OEC according to one or more embodiments used in an RCD 400. In FIG. 4, the RCD configuration includes an outer housing 402 and an OEC mounted in the outer housing 402, where the OEC is used to rotatably hold a packer assembly 408 within the outer housing 402.

The outer housing 402 of the RCD 400 is generally a stator, or stationary member. The outer housing 402 of one or more embodiments may be any suitable outer housing known to the art. For example, the outer housing assembly may be a generally tubular body, such as formed of piping, tubing, flanges, and the like.

The outer housing 402 extends axially around the rotor assembly, or rotating components, including the OEC and the packer assembly 408. The OEC includes an inner housing assembly 202, a threaded sleeve 210, and a threaded split ring 212, such as described above with respect to FIGS. 2A and 2B. In one or more embodiments, like elements described in FIG. 4 may have corresponding shapes, positions, and connections as described with reference to the elements in the OEC 200 of FIGS. 2A and 2B. To avoid redundancy, these elements will not be described again, however, it is to be understood that FIGS. 2A-2B and FIG. 4 represent only an example in accordance with one or more embodiments, and the elements with their corresponding shapes, positions, and connections are in no way to be taken as limiting.

The OEC is rotatably mounted within the outer housing 402 using one or more bearing assemblies, for example an upper bearing assembly 404 and a lower bearing assembly 406. The packer assembly 408 is connected to and held within the inner housing assembly 202 of the OEC, such that the packer assembly 408 may rotate with the OEC within the outer housing 402.

In one or more embodiments, the packer assembly 408 may be assembled within the OEC by assembling the OEC around the packer assembly 408 using one or more OEC assembly methods described herein. For example, the upper housing 204 may be positioned around an upper end of the packer assembly 408, the lower housing 206 may be positioned around a lower end of the packer assembly 408, the threaded sleeve 210 may be threaded to the upper axial end of the lower housing 206, and the threaded split ring 212 may be threaded between the threaded sleeve 210 and the upper housing 204 to secure the OEC around the packer assembly 408.

The packer assembly 408 of one or more embodiments may be any suitable packer assembly known to the art. For example, the packer assembly may be a retrievable tension packer, a retrievable compression packer with bypass, a retrievable tension/compression set-versatile landing, a retrievable hydraulic-set single string packer, a dual-string packer, a permanent sealbore packer, a retrievable sealbore packer, and the like. In the embodiment shown, the packer assembly 408 includes a packer sleeve 409 mounted at axial ends to a sleeve mount 411. One or more energizing pressure openings 414 formed between the sleeve mount 411 fluidly connect a fluid source to an area around the packer sleeve 409, where fluid may be injected to apply pressure to and energize the packer sleeve 409. The packer sleeve 409 may be energized in a radially inward direction in order to maintain a seal between the inner surface of the packer sleeve 409 and a pipe string (not shown) as it moves through the RCD 400. With the packer assembly 408 sealed to a pipe string, the packer assembly 408 and the OEC may rotate together with the pipe string (e.g., a drill string) as the pipe string is rotated for a well operation (e.g., during a drilling operation).

Figure 5A:
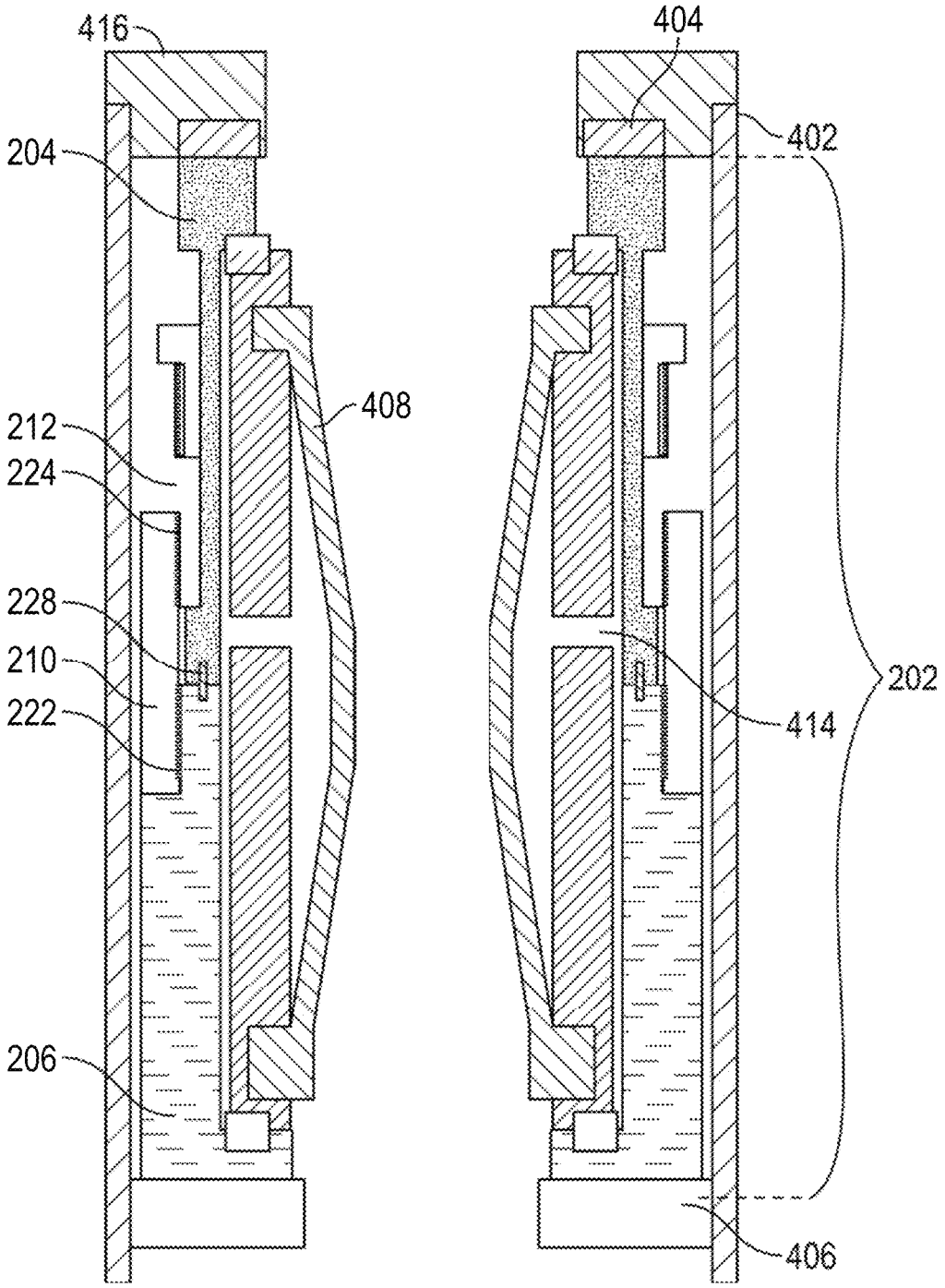
FIGS. 5A-5D show an example method for disassembling an RCD and an OEC in accordance with one or more embodiments.

FIGS. 5AB-5D show an example method for disassembling the RCD 400 of FIG. 4 in accordance with one or more embodiments. In FIG. 5A, a cap 416 may provide a threaded connection to secure the OEC and packer assembly 408 inside the outer housing 402. When the cap 416 is unthreaded from the RCD 400, the OEC may be axially removed from the outer housing 402. In one or more embodiments, when the RCD 400 is installed subsea, the OEC may be removed from the outer housing 402 and brought to a surface location.

Figure 5B:
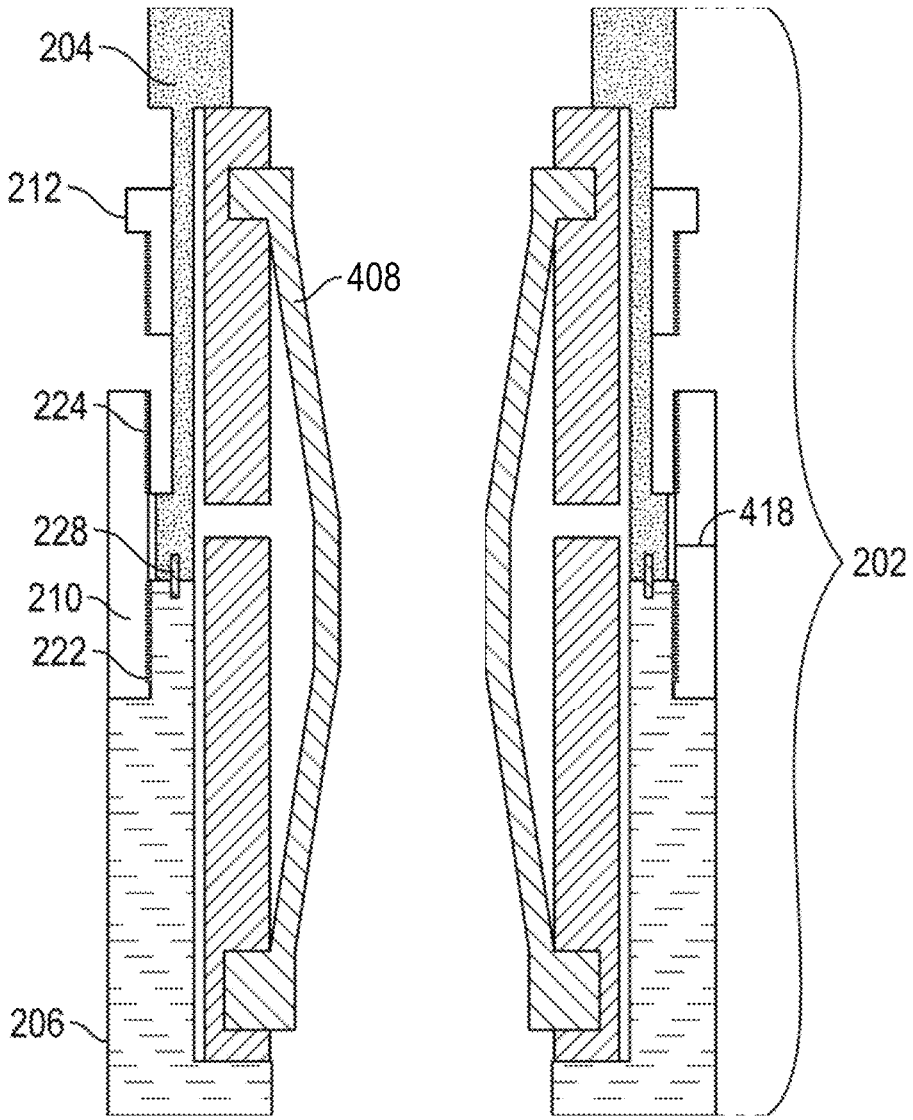

FIG. 5B shows the OEC and packer assembly 408 removed from the outer housing 402. If there is a backout prevention screw (e.g., 214 in FIG. 2B), it may be removed. As shown in FIG. 5B, the threaded split ring 212 may be rotated and axially moved about the upper housing 204 to unthread the threaded split ring 212 from the threaded sleeve 210 so that it may be removed from between the threaded sleeve 210 and the upper housing 204. Once the threaded split ring 212 is unthreaded from the threaded sleeve 210, it may be disassembled by splitting the threaded split ring 212 into at least two segments such that it may easily be removed from the upper housing 204. If the threaded split ring 212 is stuck (e.g., from corrosion), the threaded sleeve 210 may be cut through at a potential cut line 418 in a gap between the threaded sleeve 210 and the upper housing 204, in which case the threaded split ring 212, upper housing 204, and the cut upper portion of the threaded sleeve 210 may be removed together (pulled apart from the lower housing 206.

Figure 5C:
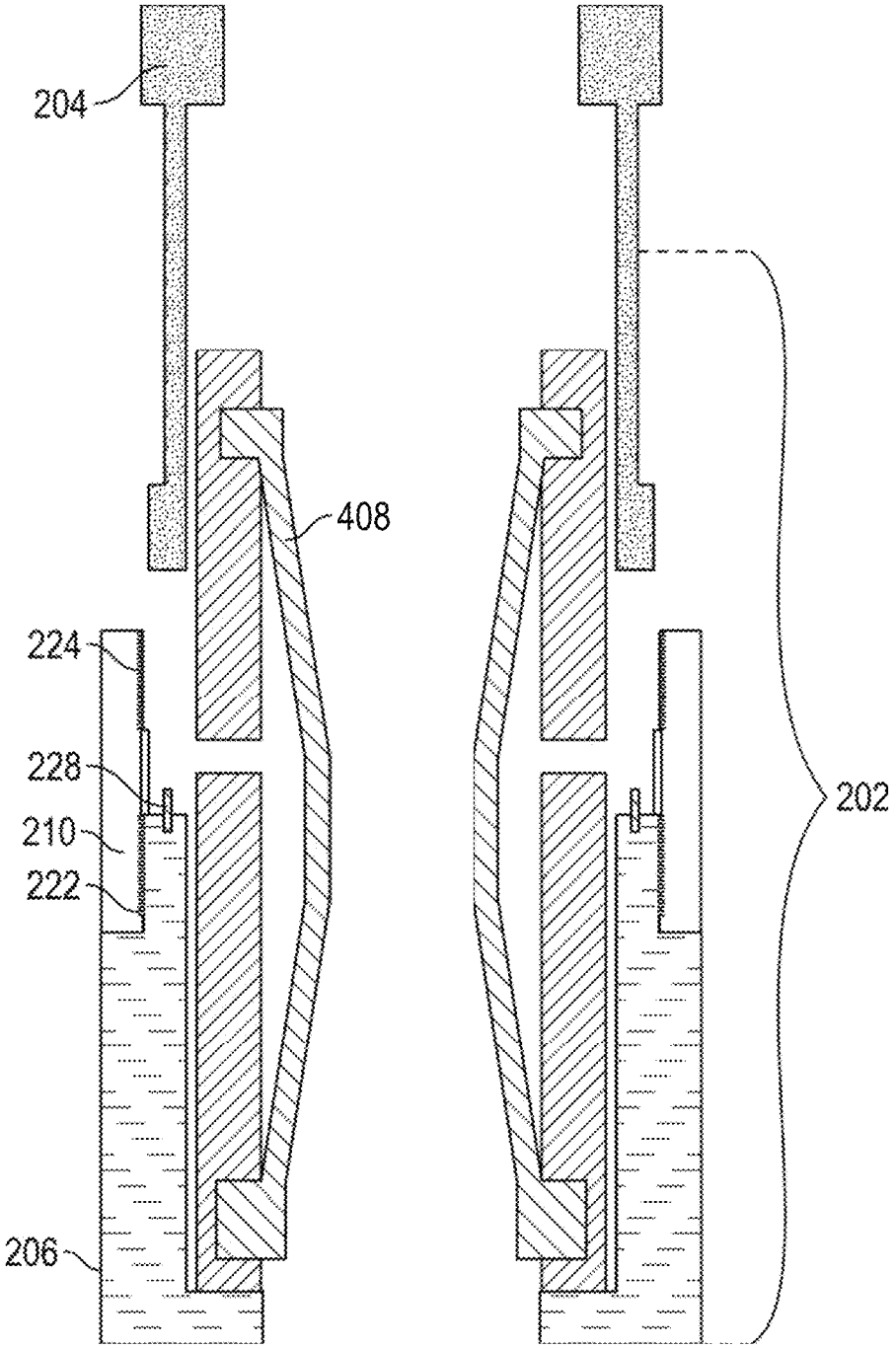

FIG. 5C shows a disassembly step where after the threaded split ring 212 is removed, the upper housing 204 may be lifted up and removed from the lower housing 206. In one or more embodiments, where housing anti-rotation key(s) 228 were used to keep the upper and lower housing angularly aligned, the upper housing 204 may be separated from the housing anti-rotation key(s) 228.

Figure 5D:
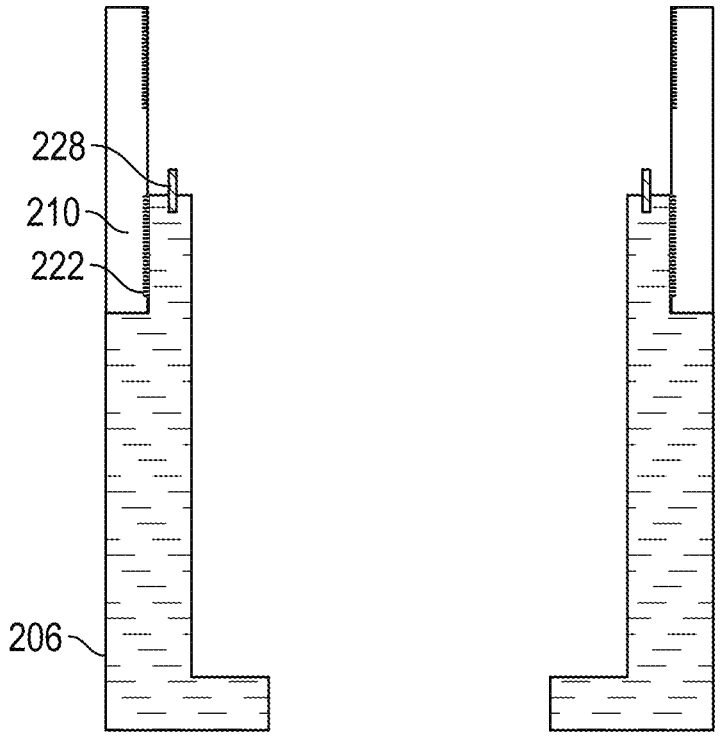

In FIG. 5D, with the upper housing 204 removed, the packer assembly 408 may be removed from the lower housing 206, e.g., for repair or replacement. The threaded sleeve 210 may remain connected to or be unthreaded from the lower housing 206.

In one or more embodiments, a packer assembly may be installed within an OED according to embodiments of the present disclosure by following the steps shown and/or described in FIGS. 5A-D in reverse order.

While FIGS. 4-5D show an OEC according to embodiments of the present disclosure used in an RCD, OECs according to embodiments of the present disclosure may be used in other applications. In one or more embodiments, OECs according to embodiments of the present disclosure may be used to connect various types of equipment, for example, pressure-rated equipment for use in the oil and gas industry.

Additionally, components used to make up an OEC according to embodiments of the present disclosure (e.g., including an upper housing, lower housing, threaded split ring, threaded sleeve, and any rotation locks such as a housing anti-rotation key and/or backout prevention screw) may be made of metal. For example, components forming an OEC may be made of one or more of a low-alloy steel, martensitic steel, stainless steel (e.g., austenitic stainless steel), Inconel (nickel-chrome-based super alloys), Hastelloy (nickel-molybdenum based alloys), titanium alloy, and/or other corrosion resistant alloy (CRA). All components of an OEC may be made of the same alloy, or one or more components of an OEC may be made of different alloys. By forming all components of an OECs from one or more alloys, the components may be easily manufactured (e.g., by casting and/or machining), tailored to specific requirements of the application in which the OEC is to be used (e.g., corrosion resistance), and able to withstand difficult environmental conditions common to the oil and gas industry.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed:

1. A method for joining housing components, comprising:
assembling an other end connection, wherein the other end connection comprises:
an inner housing assembly, wherein the inner housing assembly comprises
an upper housing, comprising a lower axial end; and
a lower housing, comprising an upper axial end; and
a coupling assembly, wherein the coupling assembly comprises:
a threaded sleeve, comprising:
a first set of threads on a first axial end; and
a second set of threads on a second axial end; and
a threaded split ring,
the assembling comprising:
threading the lower housing to the threaded sleeve at the first set of threads;
threading the threaded split ring to the threaded sleeve at the second set of threads,
wherein the threaded split ring is positioned radially between the lower axial end of the upper housing and the threaded sleeve and on a step formed on the lower axial end of the upper housing;
installing a packer assembly within the other end connection, and
placing the other end connection comprising the packer assembly inside an outer housing.

2. The method of claim 1, wherein assembling the other end connection comprises stacking the upper housing on the lower housing, such that the upper housing is adjacent to and contacting the lower housing.

3. The method of claim 1, wherein assembling the other end connection comprises providing a housing anti-rotation key between the upper housing and the lower housing to prevent relative rotation between the upper housing and the lower housing.

4. The method of claim 1, wherein assembling the other end connection further comprises inserting a backout prevention screw through the threaded split ring to contact the inner housing assembly.

5. The method of claim 1, wherein installing the packer assembly within the other end connection further comprises:
positioning the packer assembly within the other end connection such that the upper housing is positioned around an upper end of the packer assembly and the lower housing is positioned around a lower end of the packer assembly.

6. The method of claim 5, wherein placing the other end connection inside the outer housing comprises rotatably mounting the other end connection within the outer housing using one or more bearing assemblies.

* * * * *